US005865481A

United States Patent [19]

Buschmann

[11] Patent Number: 5,865,481

[45] Date of Patent: Feb. 2, 1999

[54] IMPACT-SAFE MOTOR-VEHICLE DOOR LATCH

[75] Inventor: Alexander Buschmann, Velbert, Germany

[73] Assignee: Kiekert AG, Heiligenhaus, Germany

[21] Appl. No.: 867,968

[22] Filed: Jun. 3, 1997

[30] Foreign Application Priority Data

Jun. 20, 1996 [DE] Germany ..... 196 24 640.7

[51] Int. Cl.[6] ..... E05C 3/06

[52] U.S. Cl. ..... 292/216; 292/169.11; 292/92; 292/DIG. 22; 292/DIG. 41; 292/DIG. 65; 292/DIG. 23

[58] Field of Search ..... 292/169.11, DIG. 22, 292/DIG. 41, DIG. 65, 92, DIG. 23, 216

[56] References Cited

U.S. PATENT DOCUMENTS

| | | | |
|---|---|---|---|
| 3,799,596 | 3/1974 | Nozomu et al. | 292/216 |
| 5,474,340 | 12/1995 | Brackmann et al. | 292/216 |
| 5,653,484 | 8/1997 | Brackmann et al. | 292/216 |
| 5,718,465 | 6/1996 | Dowling et al. | 292/216 |

FOREIGN PATENT DOCUMENTS

| | | |
|---|---|---|
| 1 678 024 | 8/1971 | Germany . |
| 41 17 110 | 12/1992 | Germany . |
| 195 11 651 | 10/1995 | Germany . |
| 1 413 887 | 2/1973 | United Kingdom . |

*Primary Examiner*—Steven Meyers
*Assistant Examiner*—John B. Walsh
*Attorney, Agent, or Firm*—Herbert Dubno; Andrew Wilford

[57] ABSTRACT

A motor-vehicle door latch has a latch housing formed with a recess open in an acceleration direction the latch is displaced in during a collision and, immediately adjacent the recess, with a blocking formation directed in the direction. A latching element is displaceable on the housing between a position retaining a door bolt and a position releasing the door bolt and a retaining pawl displaceable engageable with the latching element is pivotal on the housing between a retaining position holding the latching element in its retaining position and a freeing position releasing the latching element. An actuating lever pivotal on the housing is engageable with the pawl to move same into the freeing position. The actuating lever extends transversely of the acceleration. An L-shaped blocking lever has a pair of arms and is pivotal on the actuating lever between a nonblocking position with one of the arms aligned generally in the direction with the recess and engageable and the other arm extending transversely of the direction and a blocking position with the one arm aligned in the direction with the blocking formation. The blocking lever when in the blocking position prevents pivoting of the actuating lever into the freeing position. A spring urges the blocking lever into the nonblocking position. This blocking lever is constructed to pivot against the spring into the blocking position on acceleration of the lever in the direction.

4 Claims, 5 Drawing Sheets

IMPACT-SAFE MOTOR-VEHICLE DOOR LATCH

FIELD OF THE INVENTION

The present invention relates to a motor-vehicle door latch. More particularly this invention concerns such a door latch that is specially constructed so as not to unlatch in a collision.

BACKGROUND OF THE INVENTION

A standard motor-vehicle door latch is mounted on a door edge and has a latching fork that can engage around and retain a bolt projecting from a doorpost. A pawl can move between a retaining position engaging the fork and holding it in a position retaining the door bolt and a freeing position allowing the fork to pivot and free the door bolt. This pawl in turn is actuated by at least one actuating lever normally in turn operable by an outside door handle and, in most situations, by an inside door handle.

Typically the actuating lever pivots about an axis that extends horizontally in the vehicle travel direction. Thus in a side-impact collision, the considerable inertia of the actuating lever can cause it to pivot, actuating the pawl and releasing the bolt even if the handle it is connected to does not move, as lost-motion couplings are normally provided to allow the inside and outside handles and actuating elements to work independently. Thus when hit on the side the latch releases and the door can spring open, with the obvious safety problems.

Accordingly British patent 1,413,887 describes a latch having a blocking lever which is connected via a pin directly to the pawl. An extension of the blocking lever engages into a recess of the latch housing so that when the pawl is actuated by means of the actuating lever the blocking lever is similarly raised and then lowered. It is possible in a collision for this blocking lever to fail to block operation of the pawl, in particular if the latch is rusted or dirty. Furthermore the blocking lever can cause the pawl to bend, ruining the latch.

In another system described in German patent 1,678,024 an L-shaped blocking lever is pivoted on the lock housing and can swing, when moved inertially as in a crash, into a position blocking movement of the actuating lever. During normal operation, however, the blocking lever never moves so that it is possible that after a long time it becomes stuck in place, by rust and/or dirt, so that it does not work.

German patent document 195, 11 651 of Hubner shows another system with a hook-type blocking lever pivoted on the housing and engageable with the actuating lever to arrest it in an accident. This arrangement is fairly complex and adds substantial cost to the latch. The same is true for the system shown in German patent 4,117,110 of Claar.

OBJECTS OF THE INVENTION

It is therefore an object of the present invention to provide an improved motor-vehicle latch with crash-safe features.

Another object is the provision of such an improved motor-vehicle latch with crash-safe features which overcomes the above-given disadvantages, that is which is sure not to open in the event of a side collision but which is of fairly simple and inexpensive construction.

SUMMARY OF THE INVENTION

A motor-vehicle door latch has according to the invention a latch housing formed with a recess open in an acceleration direction the latch is displaced in during a collision and, immediately adjacent the recess, with a blocking formation directed in the direction. A latching element is displaceable on the housing between a position retaining a door bolt and a position releasing the door bolt and a retaining pawl displaceable engageable with the latching element is pivotal on the housing between a retaining position holding the latching element in its retaining position and a freeing position releasing the latching element. An actuating lever pivotal on the housing is engageable with the pawl to move same into the freeing position. The actuating lever extends transversely of the acceleration. An L-shaped blocking lever has a pair of arms and is pivotal on the actuating lever between a nonblocking position with one of the arms aligned generally in the direction with the recess and engageable and the other arm extending transversely of the direction and a blocking position with the one arm aligned in the direction with the blocking formation. The blocking lever when in the blocking position prevents pivoting of the actuating lever into the freeing position. A spring urges the blocking lever into the nonblocking position. This blocking lever is constructed to pivot against the spring into the blocking position on acceleration of the lever in the direction.

The levers according to the invention are provided with respective abutments that engage each other in the nonblocking position of the blocking lever. In addition the actuating lever is pivotal on the housing about an axis and the blocking lever is pivotal on the actuating lever about an axis. These axes are parallel to each other and perpendicular to the direction. The other arm has an outer end provided with a weight. Furthermore the housing is formed adjacent the blocking formation with a cam surface and on movement of the actuating lever from the retaining to the freeing position the blocking lever is engaged with the cam surface and pivoted.

Mounting the blocking lever on the actuating lever insures that it remains operational even when not used for long periods of time. In fact with the instant invention this blocking lever is pivoted somewhat every time the latch is operated, so that it will not become frozen from nonuse.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
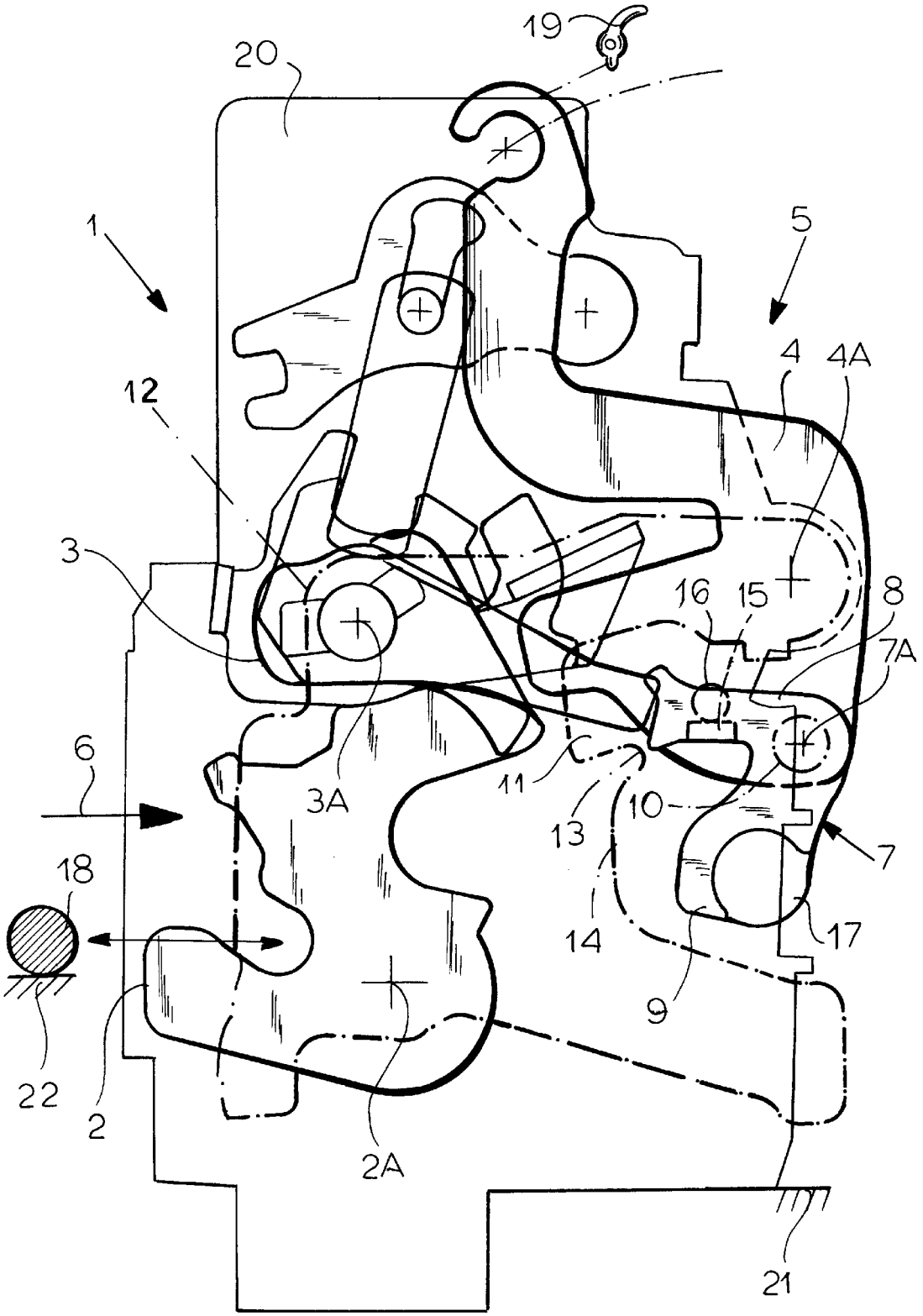
FIG. 1 is a diagrammatic side view of the door latch according to the invention.

As seen in FIG. 1 a motor-vehicle door latch 1 has a housing 20 normally fixed to an edge of a door illustrated schematically at 21 associated with a door post illustrated schematically at 22 and carrying a standard door bolt 18. A latch fork 2 is pivoted at 2A on the housing 20 and can engage around the bolt 18. A pawl 3 pivotal on the housing 20 about an axis 3A parallel to the axis 2A can move between a holding position engaging the fork 2 when it is engaged around the bolt 18 to prevent the bolt 18 from pulling out of the latch 1 and a freeing position permitting the fork 2 to pivot counterclockwise about its axis 2A and free the bolt 18. An actuating lever 4 pivotal on the housing

20 about an axis 4A parallel to the axes 2A and 3A can be pivoted clockwise about its axis by mechanism such as a door handle 19 to pivot the pawl 3 against the force of an unillustrated spring into the freeing position. Thus, as the handle 19 is actuated, the lever 4 pivots clockwise about its axis 4A to trip the pawl 3 and free the fork 2 to release the bolt 18. This is all fairly standard construction.

According to the invention a blocking assembly 5 is provided basically comprising an L-shaped blocking lever 7 having arms 8 and 9 and pivoted on the actuating lever 4 at an axis 7A parallel to the axis 4A. In the rest position the arm 8 of the lever 7 extends generally parallel to an acceleration direction 6 in which the parts 4 and 7 will be moved in case of a collision. The arm 9 whose outer end is provided with a weight plug 17 extends generally perpendicularly from the axis 7A to this direction 6. A torque spring 10 engaged between the levers 4 and 7 urges the lever 7 counterclockwise about the axis 7A, into the position of FIGS. 1 and 2. The lever 7 carries an abutment 15 engageable with an abutment pin 16 on the lever 4 to define this rest position.

The latch housing 20 includes a latch plate 12 formed with a cutout 11 aligned in the direction 6 with the arm 8. It is also formed immediately adjacent thereto and level with the arm 7 with a camming edge 14 extending perpendicular to the direction 6 and terminating at a camming point 13 from which the recess 11 extends.

Figure 2:
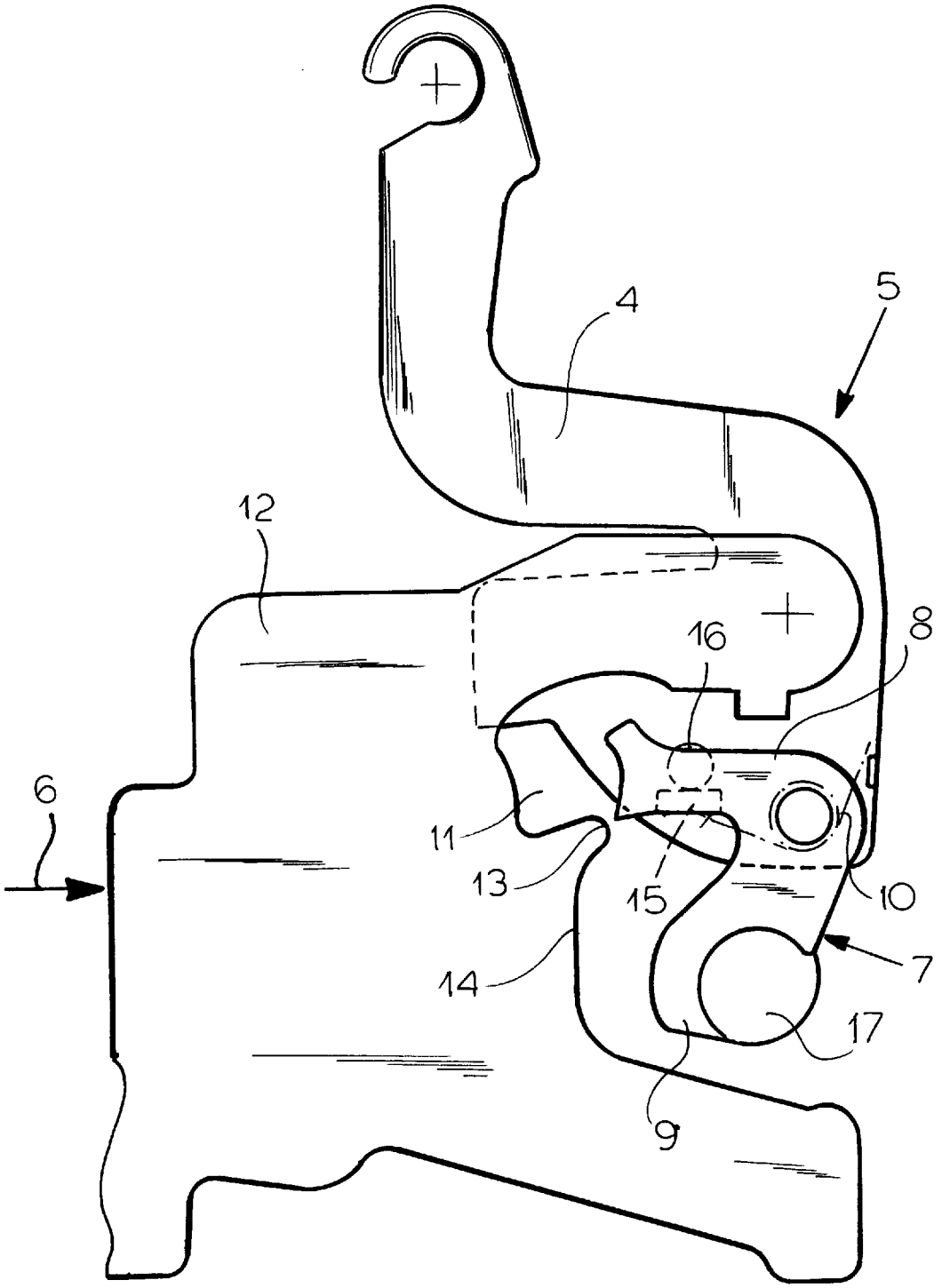
FIGS. 2 through 5 are detail views of elements of the latch in the rest, actuated and blocked, partially actuated and unblocked, and fully actuated and unblocked positions, respectively.

FIG. 2 shows the latch 1 in the rest position. The lever 7 is wholly out of contact with the latch plate 12 but generally aligned with the opening 11.

Figure 3:
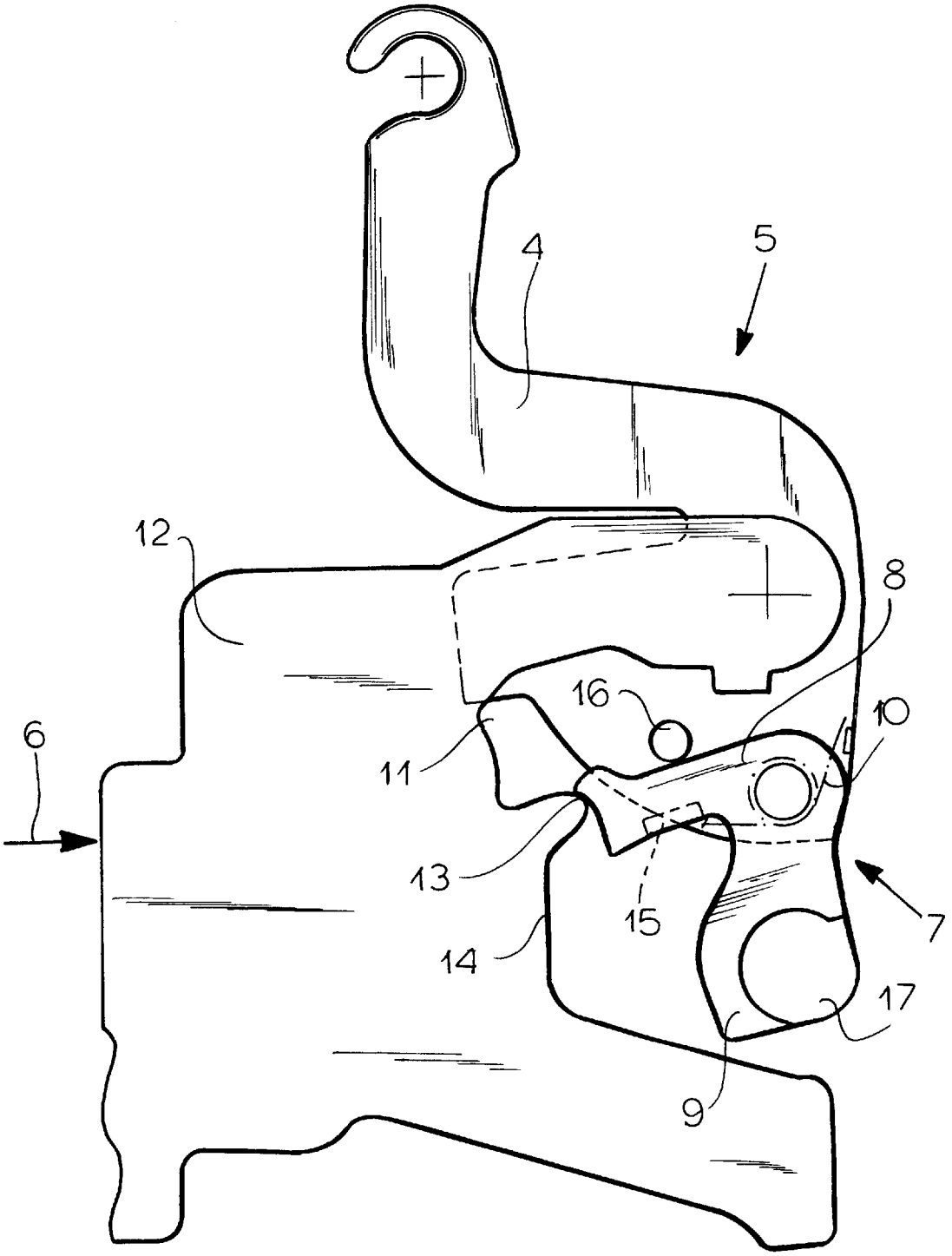

In FIG. 3 the latch parts are shown when subjected to acceleration in the direction of arrow 6. Such inertial acceleration will tend to pivot the lever 4, the bulk of whose mass is above its pivot 4A, clockwise about the axis 4A in a direction tending to open the latch. The lever 7 is, however, pivoted by these same inertial forces in the counterclockwise direction so that its arm 8 comes into alignment with the camming point 13, thereby blocking clockwise pivoting of the lever 4. The latch 1 will therefore stay closed.

Figure 4:
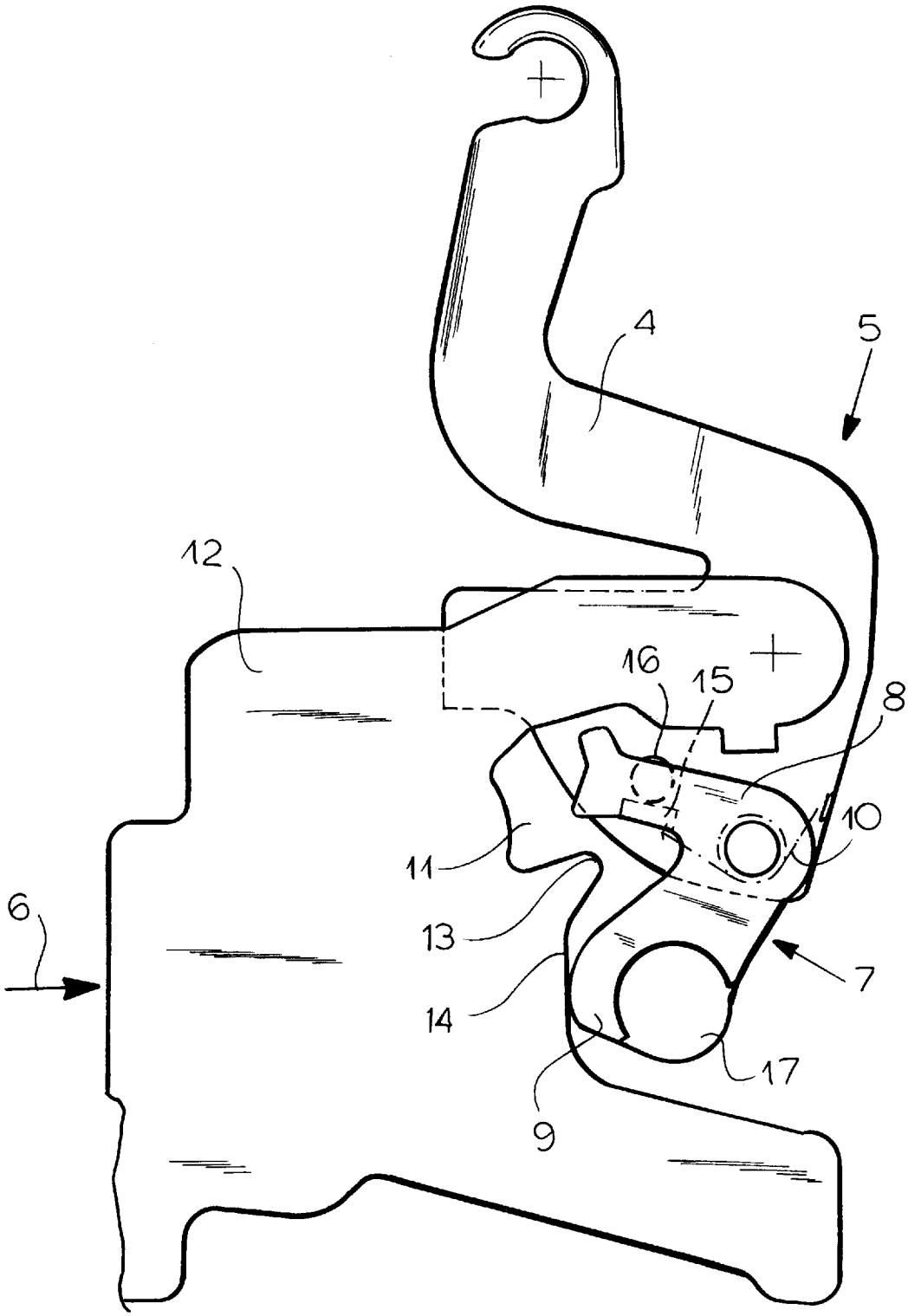
Figure 5:
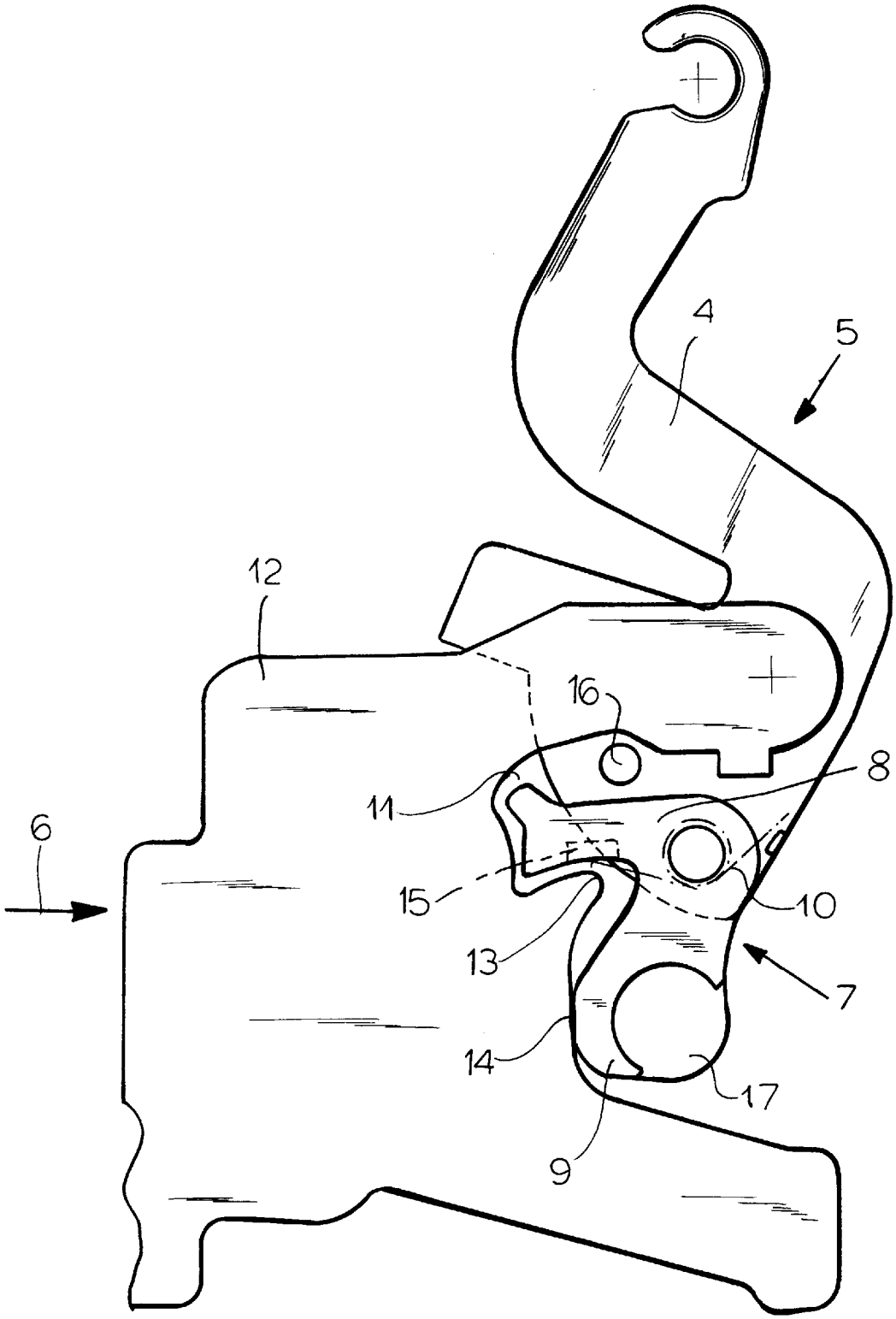

FIGS. 4 and 5 show how the latch 1 operates when opened under normal circumstances. Without a force acting on the arm 9 in the direction 6, when the lever 4 is pivoted clockwise, that is with its upper end moving in the direction 6, the arm 8 will enter the recess 11, moving past the point 13. When the lever 4 is fully actuated as shown in FIG. 5 the arm 9 engages the surface 14 to pivot the lever 7 somewhat, but this action does not prevent the lever 4 from tripping the pawl 3 and opening the latch 1.

I claim:

1. A motor-vehicle door latch comprising:

a latch housing formed with a recess open in an acceleration direction in which the latch is displaced in during a collision and, immediately adjacent tho recess, with a blocking formation directed in the direction;

a latching element displaceable on the housing between a position retaining a door bolt and a position releasing the door bolt;

a retaining pawl displaceable engageable with the latching element and pivotal on the housing between a retaining position holding the latching element in its retaining position and a freeing position releasing the latching element;

an actuating lever pivotal on the housing and engageable with the pawl to move same into the freeing position, the actuating lever extending transversely of the acceleration;

an L-shaped blocking lever having a pair of arms and pivotal on the actuating lever between a nonblocking position with one of the arms aligned generally in the direction with the recess and engageable and the other arm extending transversely of the direction and a blocking position with the one arm aligned in the direction with the blocking formation, the blocking lever when in the blocking position preventing pivoting of the actuating lever into the freeing position; and a spring urging the blocking lever into the nonblocking position, the other arm of blocking lever having an outer end provided with a weight so as to pivot against the spring into the blocking position on acceleration of the lever in the direction.

2. The motor-vehicle door latch defined in claim 1 wherein the levers are provided with respective abutments that engage each other in the nonblocking position of the blocking lever.

3. The motor-vehicle door latch defined in claim 1 wherein the actuating lever is pivotal on the housing about an axis and the blocking lever is pivotal on the actuating lever about an axis, the axes being parallel to each other and perpendicular to the direction.

4. The motor-vehicle door latch defined in claim 1 wherein the housing is formed adjacent the blocking formation with a cam surface and on movement of the actuating lever from the retaining to the freeing position the blocking lever is engaged with the cam surface and pivoted.

* * * * *